US005414493A

United States Patent [19]

Fujii et al.

[11] Patent Number: 5,414,493

[45] Date of Patent: May 9, 1995

[54] IMAGE FORMING APPARATUS

[75] Inventors: Haruo Fujii, Yokohama; Tatsuya Kobayashi, Tokyo; Nobuhiro Imai, Kawasaki; Hisayoshi Kojima, Yokohama; Masao Umezawa, Yokohama; Hideki Tada, Yokohama; Akira Ito, Tokyo; Kaoru Seto, Chigasaki; Motoi Katoh; Daisuke Murata, both of Yokohama, all of Japan

[73] Assignee: Canon Kabushiki Kaisha, Tokyo, Japan

[21] Appl. No.: 295,490

[22] Filed: Aug. 25, 1994

Related U.S. Application Data

[63] Continuation of Ser. No. 219,232, Mar. 28, 1994, abandoned, which is a continuation of Ser. No. 946,161, Sep. 17, 1992, abandoned, which is a continuation of Ser. No. 642,895, Jan. 18, 1991, abandoned.

[30] Foreign Application Priority Data

| | | | |
|---|---|---|---|
| Jan. 19, 1990 | [JP] | Japan | 2-8470 |
| Jan. 19, 1990 | [JP] | Japan | 2-8471 |
| Apr. 6, 1990 | [JP] | Japan | 2-90395 |

[51] Int. Cl.[6] ..... G03G 15/00

[52] U.S. Cl. ..... 355/200; 355/360; 355/326

[58] Field of Search ..... 346/157; 355/200, 210, 355/211, 245, 260, 326, 327

[56] References Cited

U.S. PATENT DOCUMENTS

| | | | |
|---|---|---|---|
| 4,588,280 | 5/1986 | Ogawa et al. | 355/200 |
| 4,851,960 | 7/1989 | Nakamura et al. | 361/225 |
| 4,919,071 | 4/1990 | Gatti | 355/245 X |
| 4,924,267 | 5/1990 | Yoshikawa et al. | 355/210 |
| 4,996,566 | 2/1991 | Morita | 355/246 |
| 5,005,053 | 12/1991 | Kozuka | 355/245 |
| 5,036,367 | 7/1991 | Haneda et al. | 355/260 |
| 5,070,370 | 12/1991 | Bellis | 355/271 |
| 5,086,318 | 2/1992 | Takeda et al. | 355/271 |
| 5,124,747 | 6/1992 | Hanada et al. | 355/200 |

FOREIGN PATENT DOCUMENTS 62-134654 6/1987 Japan .

*Primary Examiner*—M. L. Gellner
*Assistant Examiner*—Patrick J. Stanzione
*Attorney, Agent, or Firm*—Fitzpatrick, Cella, Harper & Scinto

[57] ABSTRACT

An image forming apparatus includes a detachably mountable process cartridge, the process cartridge including an image bearing member and a color developing device actable on the image bearing member, the color developing device containing plural developing units having yellow developer, respectively; detachably mountable developing device actable on the image bearing member in the process cartridge, the detachably mountable developing device containing black developer and being detachably mountable independently of the process cartridge; and a device for forming a latent image on the image bearing member; a transfer device for transferring a developed image from the image bearing member to a recording material.

13 Claims, 7 Drawing Sheets

IMAGE FORMING APPARATUS

This application is a continuation of prior application Ser. No. 08/219,232 filed on Mar. 28, 1994, which is a continuation of prior application Ser. No. 07/946,161 filed on Sep. 17, 1992, which is a continuation of application Ser. No. 07/642,895 filed on Jan. 18, 1991, all now abandoned.

FIELD OF THE INVENTION AND RELATED ART

The present invention relates to an image forming apparatus for forming images using an electrophotographic process or an electrostatic recording process, and particularly to an image forming apparatus capable of forming full-color images, such as a color copying machine or color printer.

Conventional image forming machines using the electrophotographic process are in the form of a copying machine or a printer using as optical means a laser beam scanner, LED array, liquid crystal shutter array or the like.

In such an image forming machine, the image forming means such as an image bearing member, a charging device, a developing device or a cleaning device is in the form of respective units constituting a part of the apparatus. When any one of them is used up to the extent of the service life, or when it is contaminated, a fresh one is used, or it is cleaned and reused.

However, the replacement of the unit or the cleaning of the unit requires the attention of an expert serviceman to and therefore, it is inconvenient for the users. Some monochromatic image forming apparatus use a detachably mountable process cartridge which includes as a unit an image bearing member (photosensitive member) and another process means such as charging device, developing device or cleaning device.

The process cartridge is exchanged as a whole with a new process cartridge when the toner in the developing device is used up, when the cleaning device is filled with the residual toner or when the photosensitive member or the developing device is used up to its service life. By doing so, the maintenance operation is made easier.

On the other hand, a full-color image forming apparatus includes a plurality of developing devices around the image bearing member. The developing devices contain yellow toner, magenta toner, cyan toner (chromatic toners) and black toner. When any one of the toners is used up, the operator is required to replenish the toner through a series of predetermined steps. With this structure, the necessity for the replenishment of the toner occurs whenever any one of the toners is used up. The toner replenishing operation is cumbersome with the possibility of contamination, so that all of the users do not carry out the replenishing operation without difficulty.

Then, it is considered that the form of a process cartridge used in the monochromatic image forming apparatus is employed in the full-color image forming apparatus.

However, the full-color image forming apparatus requires the provision of a plurality of developing devices containing the yellow toner, the magenta toner, the cyan toner (chromatic) and the black toner. No proper solution has been provided as to the problem of what arrangement is optimum in such a cartridge. More particularly, in order to realize the cartridge structure in the full-color image forming apparatus, there is a problem as to how to meet the difference in the consumption of the different toners and a problem of providing easy handling structure for the cartridge.

SUMMARY OF THE INVENTION

Accordingly, it is a principal object of the present invention to provide an image forming apparatus capable of forming full-color images in which the process cartridge is incorporated.

It is another object of the present invention to provide an image forming apparatus wherein the difference in the consumption in use of the different developers are properly taken into account.

It is a further object of the present invention to provide an image forming apparatus wherein replacement of various means and the replenishment of the developer can be carried out by users without difficulty.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, a description will be made as to the preferred embodiments of the present invention.

Figure 1:
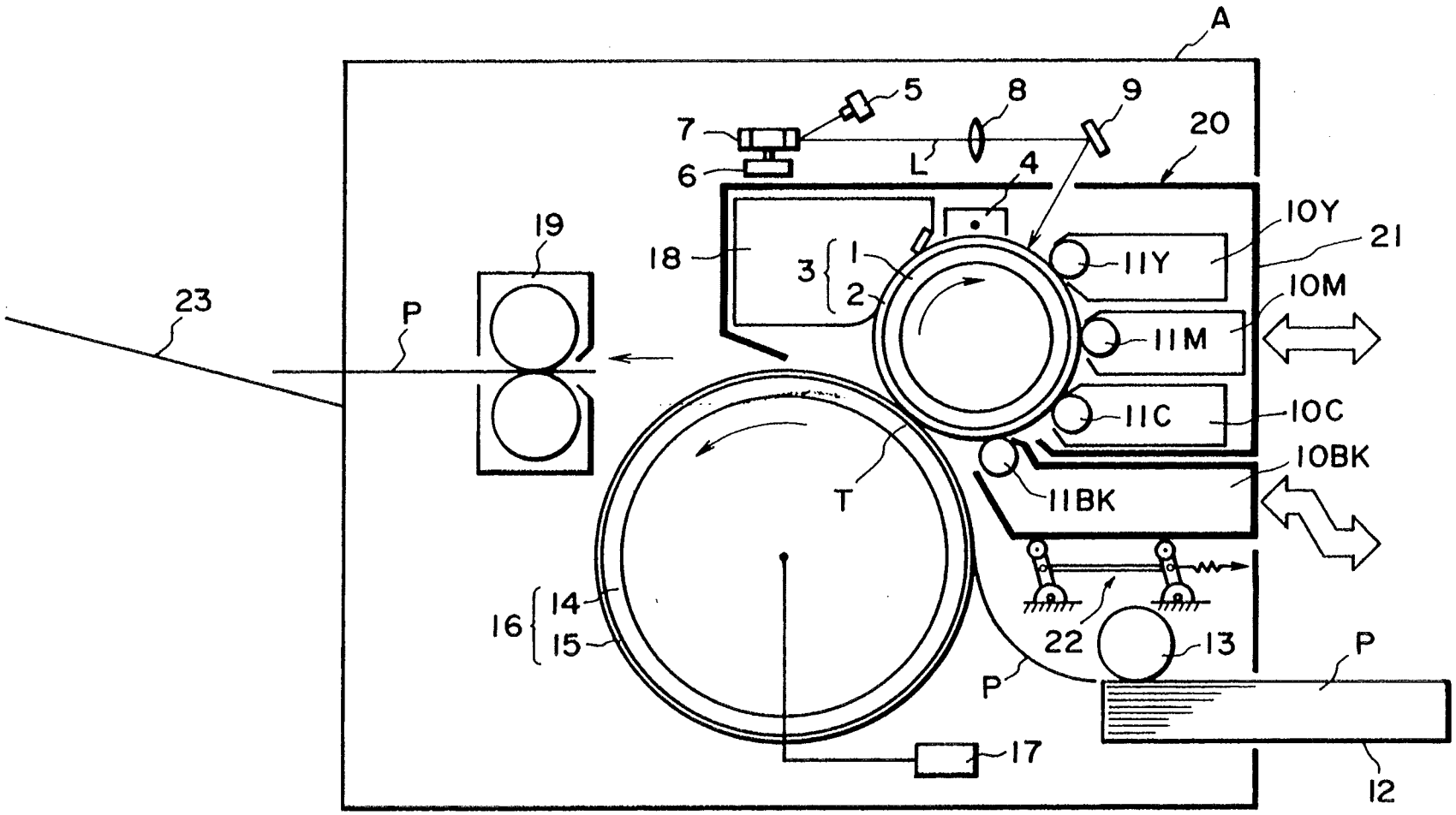
FIG. 1 is a sectional view of an image forming apparatus according to a first embodiment of the present invention.

Referring to FIG. 1, there is shown an image forming apparatus in the form of a laser beam printer in cross-section. As shown in this figure, a process cartridge 20 is detachably mounted in a main assembly A of the apparatus. The process cartridge 20 includes as a unit, in a cartridge container 21, an image bearing member in the form of a photosensitive drum 3, a charging device in the form of a corona charger 4, a plurality of chromatic color toner developing devices (chromatic color developing devices) 10Y, 10M and 10C, and a cleaning device 18. The charging device, the developing device and the cleaning device are process means actable on the image bearing member. In this embodiment, the photosensitive drum 3 comprises an aluminum cylinder 1 having a diameter of 60 mm and a photoconductor (organic photoconductor) 2 applied thereon. It is rotated by an unshown driving means at a peripheral speed of 50 mm/sec in the direction indicated by an arrow. In the developing devices 10Y, 10M and 10C, there are contained yellow toner, magenta toner and cyan toner, respectively. Each of the color developing devices 10Y, 10M and 10C is provided with toner supplying rollers 11Y, 11M and 11C, respectively. The supplying rollers 11Y, 11M and 11C carry the respective toner particles to develop latent images formed on the photosensitive drum 3 through a process which will be described hereinafter. As desired, the developing devices may be detachable from the cartridge 20.

Below the cartridge 21, a black developing device 10BK containing black toner is detachably mounted. The black developing device 10BK is provided with a toner supplying toner 11BK which is shown as being urged toward the photosensitive drum 3 by a pressing device 22. That is, the black developing device 10BK is at the operating position relative to the photosensitive drum 3 in which the toner supplying roller 11BK is exposed through the cartridge 20. By releasing the urging by the pressing device 22, the black developing device 10BK is moved to a position retracted from the operating position. Then, the black developing device 10BK can be dismounted from the main assembly A.

Figure 2A:
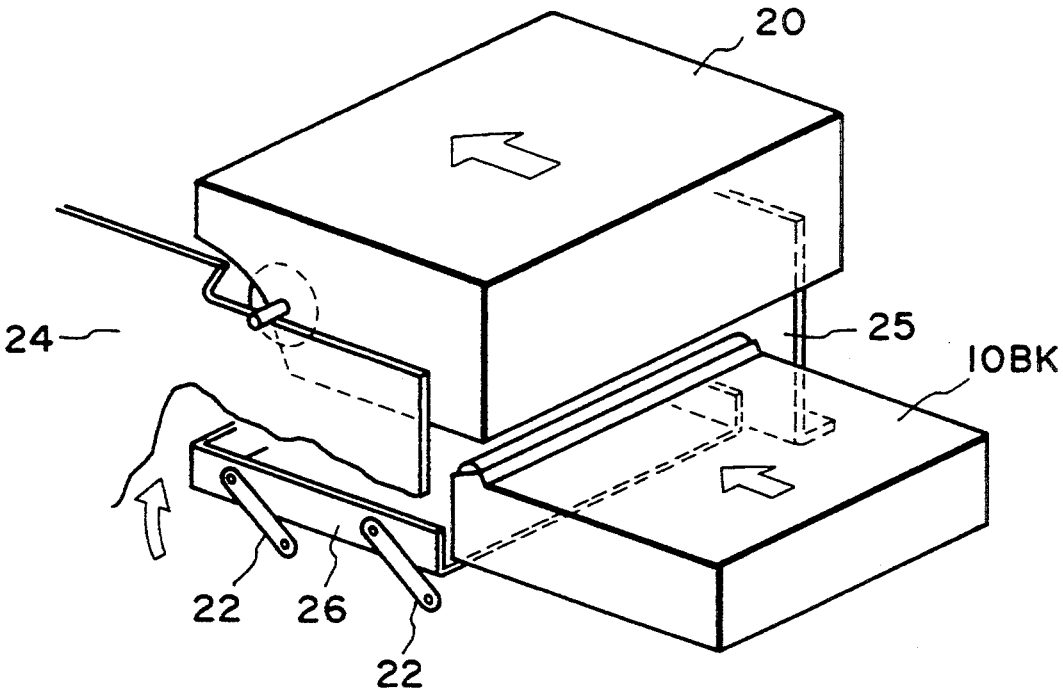
FIGS. 2A and 2B are a perspective view of a major part illustrating mounting of the process cartridge and the black toner developing device into the apparatus of FIG. 1.
Figure 2B:
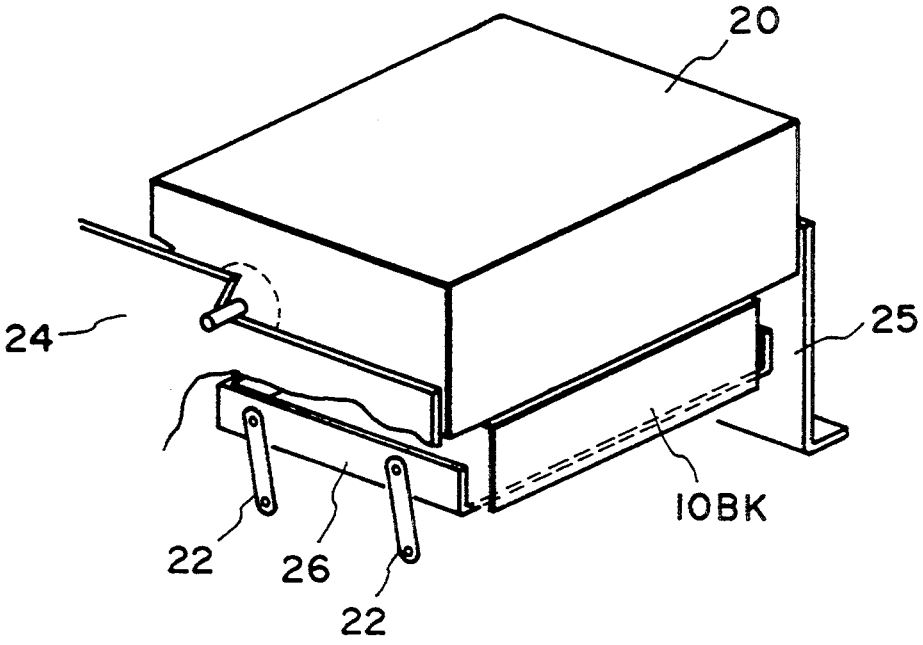

FIGS. 2A and 2B illustrate the mounting of the process cartridge 20 and the black developing device 10BK to the main assembly A. In FIG. 2A, the process cartridge 20 and the black developing device 10BK are not yet mounted into the apparatus. In FIG. 2B, the process cartridge 20 and the black developing device 10BK have been mounted into the apparatus.

The process cartridge 20 is guided by the side plates 24 and 25 of the main assembly and is inserted in the direction of the arrow in FIG. 2A. It is correctly positioned by a proper positioning means at the predetermined position, shown in FIG. 2B.

On the other hand, the black developing device 10BK is released from the pressing device 22, and with the released state, it is inserted in the direction of the arrow 2A to the supporting table 26 coupled with the pressing device 22. By the urging of the pressing device 22, it is correctly positioned relative to the photosensitive drum 3, as shown in FIG. 2B.

In FIG. 1, the supporting table 26 is omitted for simplicity.

When the black developing device 10BK is dismounted from the main assembly, the urging by the pressing device 22 is released, and the supporting table 26 is moved from the position of FIG. 2B to the position of FIG. 2A, and it is dismounted.

When the process cartridge 20 is dismounted from the main assembly, the urging by the pressing device 22 is released, and with this state, it is retracted in the direction indicated by an arrow from FIG. 2B position to the FIG. 2A position.

In this manner, the process cartridge 20 and the black developing device 10BK are separately detachably mountable relative to the main assembly.

Above the cartridge 20 in the main assembly A, there are a laser diode 5, a polygonal mirror 7 rotated by a high speed motor 6, a lens 8 and a folding mirror 9 which constitute the optical means. Adjacent the center of the main assembly A, there is a transfer rotatable member 16. The transfer rotatable member 16 comprises a metal cylinder 14 having a diameter of 116 mm and a sheet 15 having a thickness of 2 mm. It is rotated in the direction indicated by an arrow by an unshown driving means. In the embodiment, the sheet 15 is made of resin in which carbon, zinc oxide or the like are dispersed. It has a volume resistivity of $10^7$–$10^{13}$ ohm.cm. In FIG. 1, an external voltage source 17 supplies a bias voltage to the transfer rotatable member 16.

To the left and right sides of the rotatable member 16 in the main assembly A, an image fixing device 19 and sheet feeding rollers 13 are disposed. A recording sheet cassette 12 is inserted into the main assembly A. To the opposite side, there is a sheet discharging tray 23. In the recording sheet cassette 12, there are plural recording sheets P.

A description will be made as to the image forming operation, particularly, a full-color image forming operation in the image forming apparatus of this embodiment.

The photosensitive drum 3 in the cartridge 20 is rotated in the direction of the arrow, and during the rotation, it is uniformly charged by the corona charger 4 to approximately −600 V.

Next, when an electric signal corresponding to the yellow component is supplied to the laser diode 5, the laser diode 5 emits a beam L modulated in accordance with the electric signal to the polygonal mirror 7. The beam L is reflected by the polygonal mirror 7 and is passed through the lens 8, and is folded by the folding mirror 9 and is directed to the photosensitive drum 3. By the application of the beam L, an electrostatic latent image is formed on the photosensitive drum 3 in accordance with the image signal. The energy of the beam is selected so that the surface potential of the photosensitive drum 3 at the portion exposed to the light is −60 V.

The electrostatic latent image formed on the photosensitive drum 3 is developed by the color developing device 10Y. More particularly, a so-called reverse development is effected wherein the toner supplying roller 11Y is supplied with substantially the same voltage having the same polarity (−500 V) as the charge on the photosensitive drum 3 so that the yellow toner is deposited onto the illuminated portion of the photosensitive drum 3. As for the applied voltage, it may be a DC (−500 V) biased AC voltage (several KV), if desired.

The usable developing methods include a known two component magnetic brush developing method, a cascade developing method, attach-down developing method, a jumping developing method or cloud developing method. When the developing operation is performed with the developing device 10Y, the developing devices 10M, 10C and 10BK have to be disabled. To accomplish this, the developing devices 10M, 10C and 10BK are moved away from the photosensitive drum 3, or the toner supplying rollers 11M, 11C and 11BK of the developing devices are supplied with a sufficient reverse bias voltage. By doing so, the toner particles are not deposited to the photosensitive drum in the developing devices 10M, 10C and 10BK. The developing actions of the developing devices 10M, 10C and 10BK may be disabled by a combination of the above methods.

The recording sheet P in the recording sheet cassette 12 is supplied by a supplying roller 13 and is wrapped around the transfer rotatable member 16. Therefore, the circumferential length of the transfer rotatable member 16 is selected to be longer than the length of the used recording sheet P. The rotatable member 16 is provided with a gripper or air sucking means, as desired, in order to grip a leading edge of the recording sheet P. Otherwise, it may be provided with an insulating sheet such as a Mylar sheet on the surface of the sheet 15 to attract the recording sheet on the rotatable member 16 using an electrostatic attraction roller or the like.

In this embodiment, the photosensitive drum 3 and the transfer rotatable member 16 are so arranged that they have parallel longitudinal axes (perpendicular to the sheet of the drawing of FIG. 1). They are contacted to each other with a predetermined pressure by an unshown means to constitute an image transfer station T.

The rotatable member 16 is supplied with a voltage of +1–5 KV having a polarity opposite from that of the toner from an external voltage source 17. When the recording sheet P has a width of 210 mm and a basis weight of 80 g/m$^2$, the transfer current is selected as being 1–1.5 micro-amperes, by which the yellow toner is transferred at the transfer station T on the recording sheet P wrapped on the rotatable member 16, by which the yellow visualized image is provided on the recording sheet P. The toner not transferred onto the photosensitive drum 3 and remaining on the photosensitive drum 3 is removed by a cleaning device 18 having a blade, fur brush, magnetic brush or another cleaning means.

The photosensitive drum 3 is uniformly charged by the corona charger 4, again. Then, it is exposed to a beam L corresponding to the magenta component, by which an electrostatic latent image is formed, and the electrostatic latent image is visualized by the color developing device 10M into a visualized magenta image. The magenta visualized image is superposedly transferred onto the yellow image by the repetitive movement of the rotatable member 16 to the transfer station T, while carrying the recording sheet P having the transferred yellow toner image.

In the similar manner, a cyan toner image and a black toner image are sequentially formed on the photosensitive drum 3 by the developing device 10C and 10BK, and onto the recording sheet P, the cyan toner and black toner images are further superposedly transferred. Thereafter, the recording sheet P is separated from the rotatable member 16 by separating means, and is fed to the image fixing device 19. In the fixing device 19, the transferred yellow toner image, the magenta toner image, cyan toner image and black toner image on the recording sheet P are heated and pressed so that they are fixed. The recording sheet P is then discharged to the discharging tray 23.

In this embodiment, the full-color images are formed by four color developers, namely, yellow, magenta, cyan and black developers. This is not limiting, and it is possible to form full-color images with yellow, magenta and cyan toners.

In this embodiment, the photosensitive drum 3, the corona charger 4, the color developing devices 10Y, 10M and 10C and the cleaning device 18 are contained as a unit in an accommodator 21 to constitute a process cartridge 20. The process cartridge as a whole is detachably mountable to the main assembly M. The black developing device 10BK is separately detachably mountable into the main assembly A, and therefore, the apparatus can meet the difference in the consumption of the black toner and the chromatic toner (yellow, magenta or cyan). More particularly, when the color images are mainly printed, the cartridge 20 is replaced with a fresh one when any one of the yellow toner, the magenta toner and the cyan toner is used up, or when the cleaning device 18 therefor becomes full. In this case, the black toner is still remaining in the black developing device 10BK which is not frequently used, and therefore, it is not necessary to exchange the black developing device 10BK with a fresh one, and therefore, it is continued to be used.

Empirically, it is confirmed that the consumptions of the yellow, magenta and cyan toners are substantially equal, except for extreme cases. This means that when one of the chromatic toner particles are used up, the other chromatic toner particles are almost used up. Therefore, even if the chromatic color developing devices 10Y, 10M and 10C are contained as a unit in the container 21 to constitute the cartridge 20 as in this embodiment so that the entire cartridge 20 is replaced with a fresh one when one of the chromatic toner particles is used up, the other chromatic toner particles are not wasted. In addition, the operativity of the cartridge 20 is remarkably improved.

On the other hand, when chromatic documents not having the chromatic images, are printed. The consumption of the black toner becomes large with the result that the black toner is relatively quickly used up. In that case, the cartridge 20 is left in the main assembly, and only the black developing device 10BK is replaced.

When the chromatic color images are mainly produced, the relatively expensive cartridge 20 are replaced more quickly with the result of higher cost per print as compared with the case of the monochromatic image forming apparatus. However, the users will understand the situation because the chromatic color images are frequently printed.

In the case of the frequent monochromatic image formations, the frequency of the cartridge 20 replacement can be delayed because the black developing device 10BK can be independently replaced, and therefore, the cost per print is substantially equivalent to that of the monochromatic image forming apparatus.

According to this embodiment, the chromatic color developing devices are constituted as a unit, and therefore, the necessity for the replacement of the chromatic color developing devices or the image bearing member or the cleaning thereof or the toner replenishment by the expert serviceman is eliminated, and the user can effect the servicing operation without difficulty.

In this embodiment, the cartridge 20 is constituted by containing as a unit in the container 21 the developing devices 10Y, 10M and 10C together with the photosensitive drum 3 or the like, and therefore, an opening for the photosensitive drum 3 formed in the container 21 is limitedly formed for the image exposure, for the black developing device 10BK and for the transfer rotatable member 16. Therefore, the inconvenience such as damage to the photosensitive drum 3 does not occur when the cartridge 20 is handled independently.

According to this embodiment, it is advantageous to move the process cartridge 20 in the directions shown in FIGS. 1, 2A and 2B.

More particularly, when the photosensitive drum 3 is moved away from the transfer rotatable member 16, the photosensitive drum 3 can be easily taken out without damage to the photosensitive drum 3 or to the transfer rotatable member 16 while maintaining the substantial parallelism between the rotatable member 16 and the photosensitive drum 3 without particularly moving the rotatable member 16, by removing the process cartridge 20 toward the photosensitive drum side in a direction crossing with a tangential plane including the contact portion between the photosensitive drum 3 and the transfer rotatable member 16. In this example of FIG. 1, the process cartridge 20 is retracted toward the right substantially horizontally from the position in which the photosensitive drum is in contact with the rotatable member 16.

Figure 3:
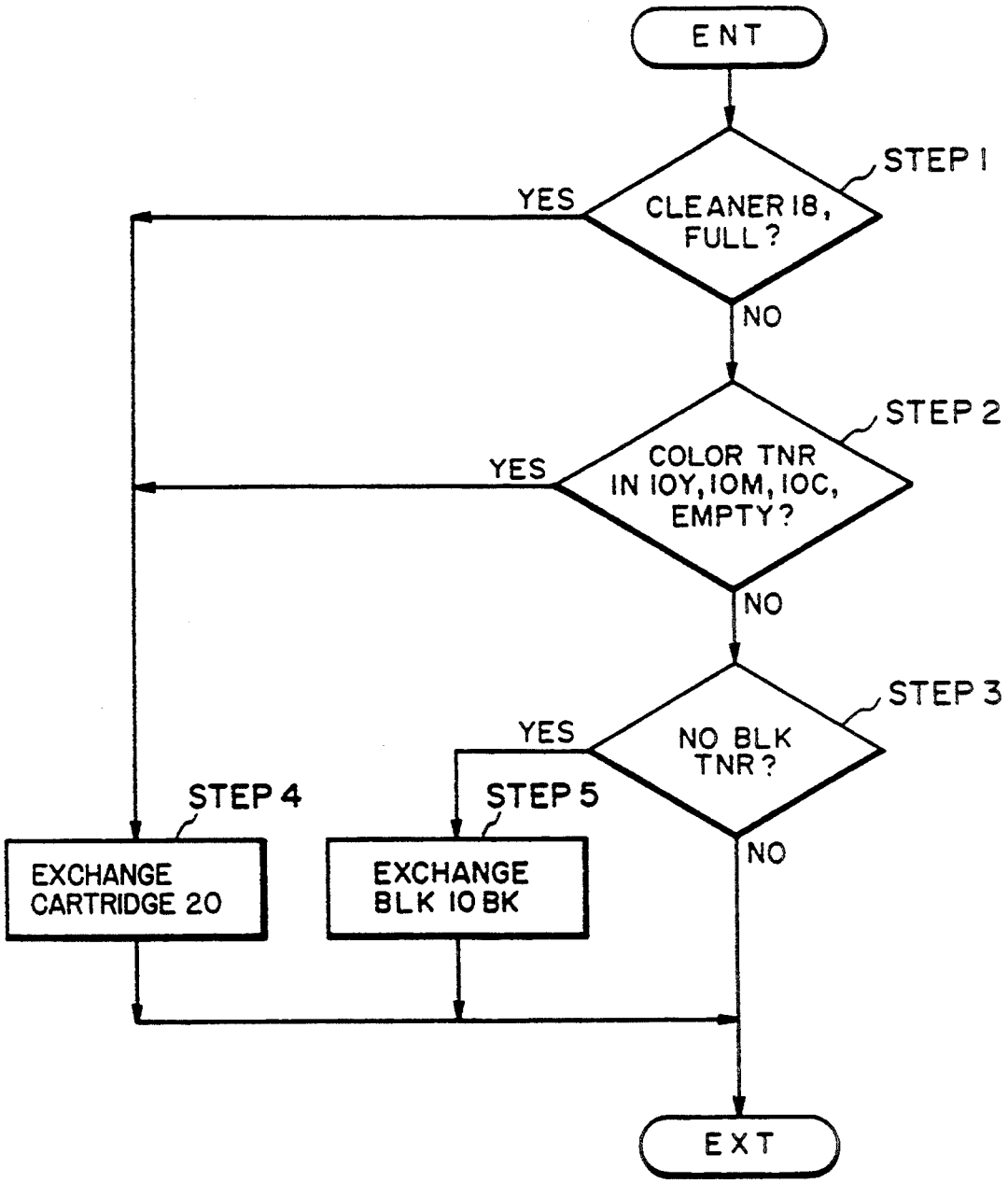
FIG. 3 is a flowchart of discriminating operation as to whether the cartridge or the black developing device is to be replaced.

Referring to the FIG. 3 (flowchart), a description will be made as to the discrimination whether the cartridge 20 or the black developing device 10BK is to be replaced.

First, the discrimination is made as to whether the cleaning device 18 in the cartridge 20 is full-or not on the basis of a detection signal from a first detecting means (step 1). If so, the cartridge 20 is replaced (step 4). If not, the discrimination is made as to whether or not any one of the chromatic color developing devices 10Y, 10M and 10C is empty on the basis of a detection signal from a second detecting means (step 2). If any one of the chromatic developing devices is empty, the cartridge 20 as a whole is replaced (step 4). If not empty, the discrimination is made as to whether the black developing device 10BK is empty or not on the basis of a detection signal by a third detecting means (step 3). If so, the black developing device 10BK is replaced, or the toner is supplied thereto (step 5). If it is not empty, the printing operation is continued.

Figure 4:
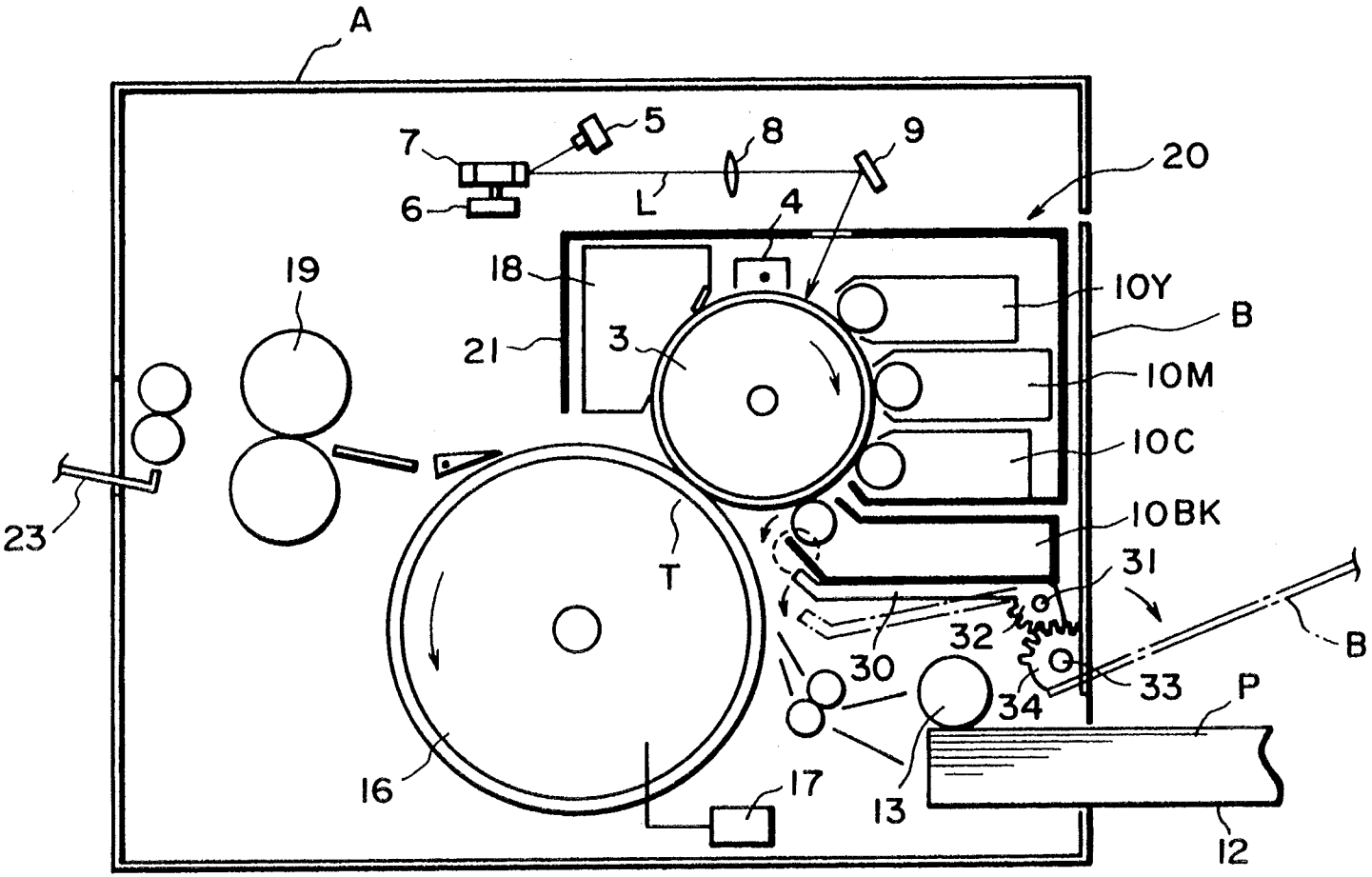
FIG. 4 is a sectional view of an image forming apparatus according to a second embodiment of the present invention.

Referring to FIG. 4, another embodiment will be described. In the foregoing embodiment, the black developing device 10BK is permitted to be mounted or dismounted by releasing from the urging action of the pressing device 22 to the black developing device 10BK. When the black developing device 10BK is moved to the retracted position, the process cartridge 20 is permitted to be mounted or dismounted.

In this embodiment, when a cover B of the main assembly A is opened, the portion of the black developing device 10BK adjacent to the photosensitive drum 13 is moved away from the photosensitive drum 3, and the process cartridge 20 and the black developing device 10BK are easily mounted or dismounted relative to the main assembly A.

More particularly, the photosensitive drum 3 side of the supporting table 30 for supporting the black developing device 10BK is vertically swingable about a shaft 31 of the cover B, and a gear teeth 32 are formed around the shaft 31 of the supporting table 30. Correspondingly, a rotatable shaft 33 below the cover B is formed with a gear 34 which is meshed with the gear 32. When the cover B is rotated in the clockwise direction from the position indicated by a solid line in FIG. 4, the photosensitive drum 3 side of the supporting table 30 moves downwardly, by which the photosensitive drum 3 side of the black developing device 10BK is moved away from the photosensitive drum 3.

Therefore, when the process cartridge 20 or the black developing device 10BK is mounted or dismounted relative to the main assembly, the cover B is opened, by which the supporting table 30 is inclined by the cooperation of the gear 34 and the gear 32 of the supporting table 30, so that an end of the black developing device 10BK is moved away from the photosensitive drum 3. Then, the photosensitive drum 3 side of the process cartridge 20 is separated from the black developing device 10BK.

Subsequently, one or both of the process cartridge 20 and the black developing device 10BK are taken out and are replaced with fresh ones. Then, the cover B is closed, upon which the supporting table 30 returns to its original position, and therefore, the black developing device 10BK is returned to the operative position relative to the photosensitive drum 3.

Figure 5:
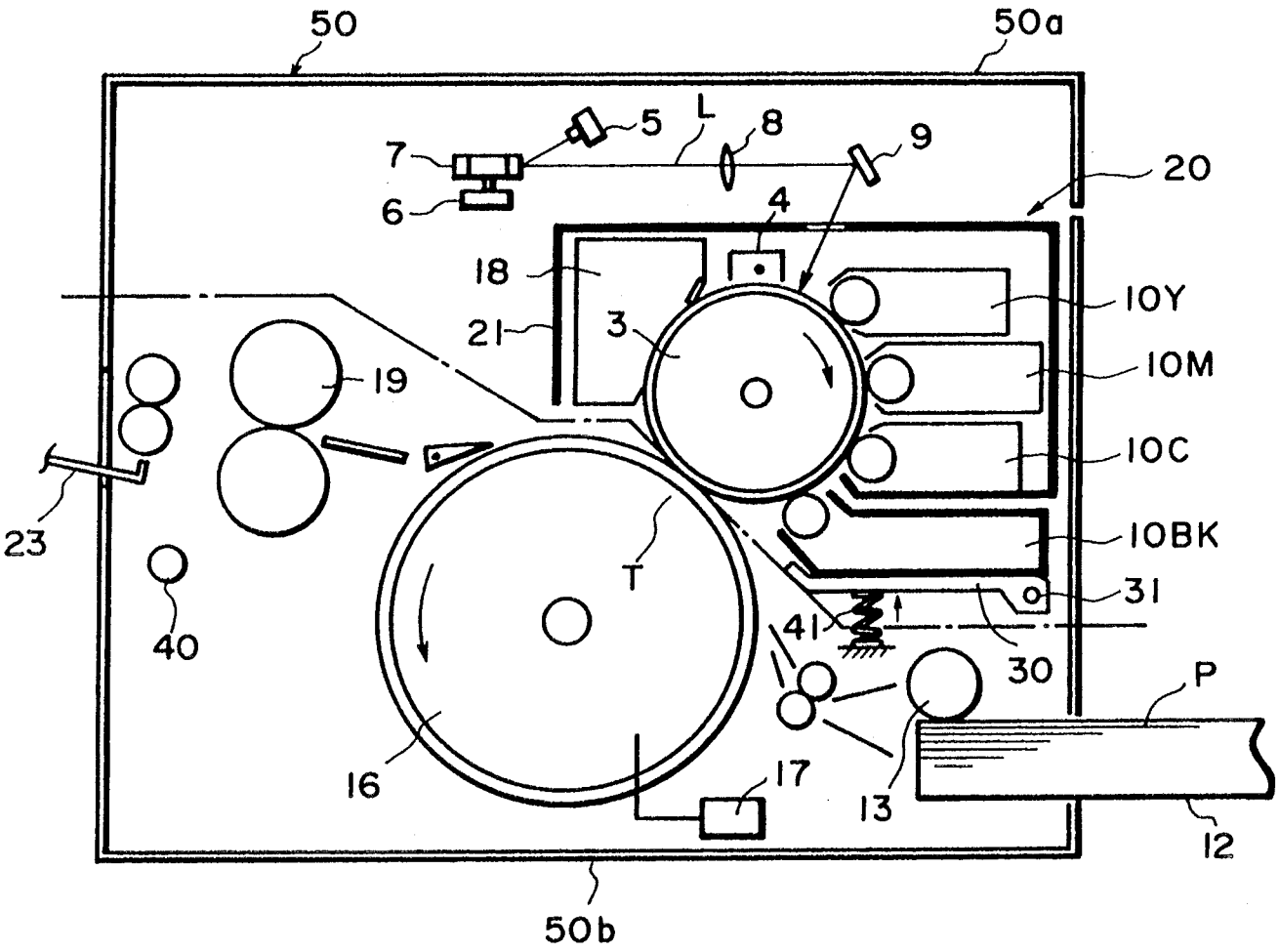
FIGS. 5 and 6 are sectional views of an image forming apparatus according to a third embodiment of the present invention.

Referring to FIG. 5, a further embodiment will be described wherein the cover in the foregoing embodiment is a frame of the main assembly. In this embodiment, the process cartridge 20 is supported on a top frame **50*a* of the main assembly 50 of the apparatus. The top frame 50*a* is rotatable relative to the bottom frame 50*b* to permit the mounting and dismounting of the process cartridge 20 relative to the main assembly 50**.

As shown in FIG. 5, the top frame **50*a* of the main assembly 50 is vertically rotatable relative to the bottom frame 50*b* about the shaft 40. The process cartridge 20 and the black developing device 10BK are supported on the top frame 50*a***.

The black developing device 10BK is urged upwardly through the supporting table 30 at the photosensitive drum 3 side by a spring member 41 having an end fixed on the bottom frame **50*b*. The photosensitive drum 3 side of the black developing device 19 is urged close to the process cartridge 20 to permit the developing operation. When the process cartridge 20 and the black developing device 10BK are detachably mounted or dismounted relative to the main assembly, the top frame 50*a* of the main assembly 50 is rotated to the position shown in FIG. 6 to open the apparatus. Then, the process cartridge 20 and the black developing device 10BK are moved to a position where they can be accessed externally. At this time, the photosensitive drum 3 side of the black developing device 10BK is released from the urging of the spring member 41, and therefore, the supporting table 30 rotates in the counterclockwise direction to an unshown stopper position about the shaft 31, by which the black developing device 10BK is sufficiently moved away from the photosensitive drum 3**.

Therefore, the process cartridge 20 and the black developing device 10BK are prevented from mutual interference, and therefore, they can be mounted or dismounted in the direction of the arrow relative to the main assembly.

Figure 6:
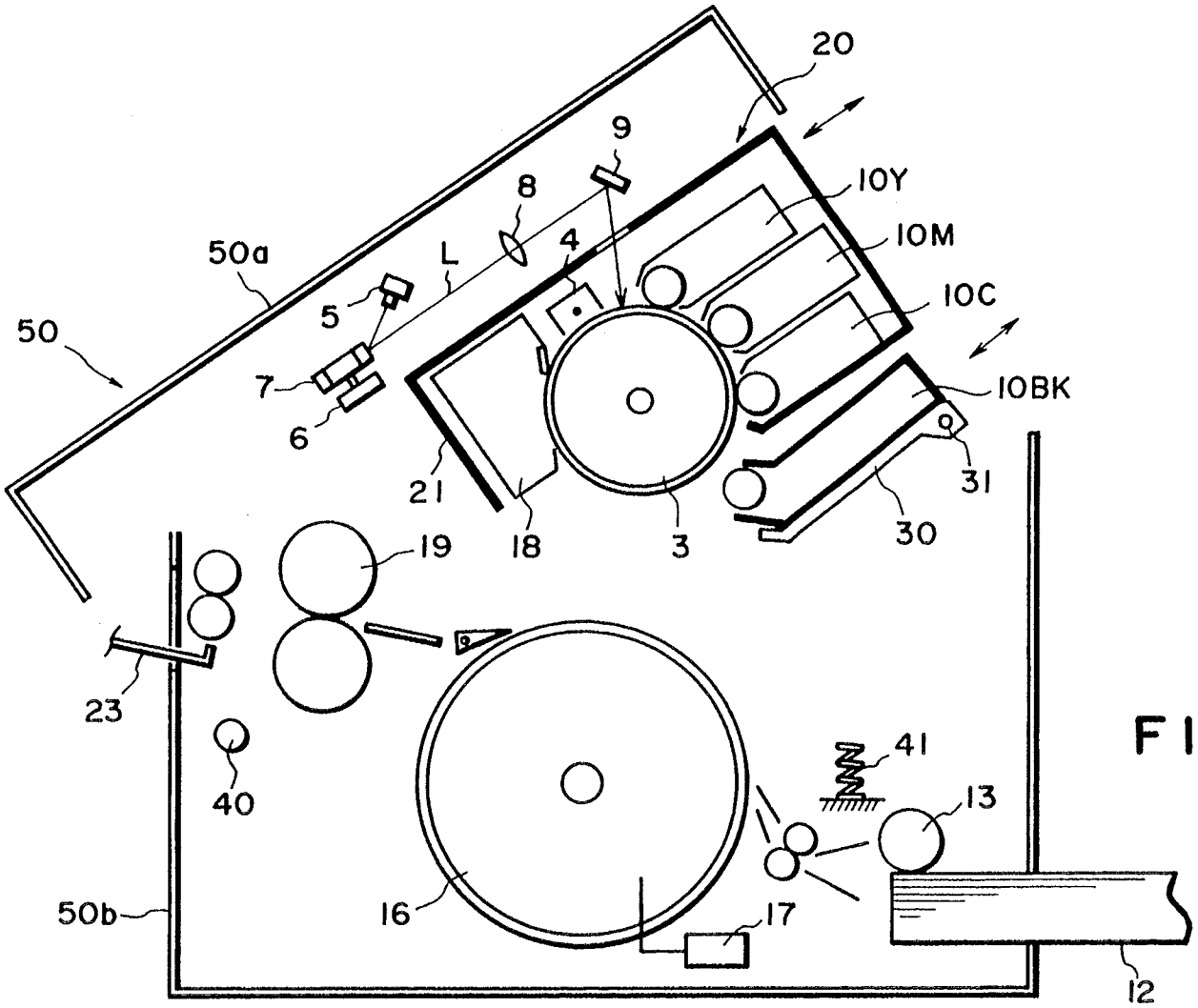

After the replacement is accomplished, the top frame **50*a* is rotated in the clockwise direction from the state shown in FIG. 6, by which the supporting table 30 for the black developing device 10BK is contacted to the spring member 41. Then, when the top frame 50*a* is locked with the bottom frame 50*b* by an unshown locking means, the black developing device 10BK is urged again to the photosensitive drum 3 with a predetermined urging force, upon which it is correctly positioned at the predetermined position shown in FIG. 5**.

Figure 7:
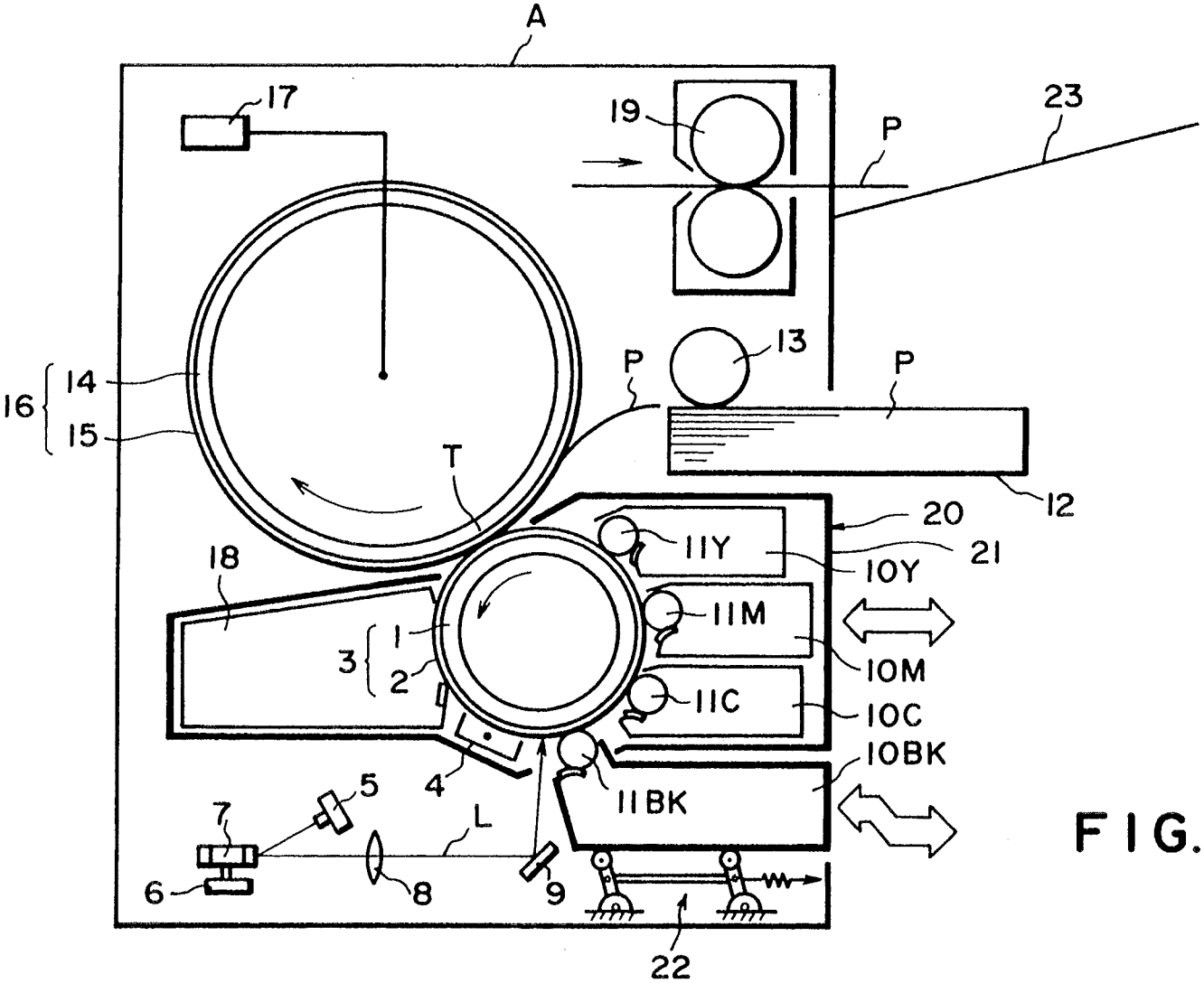
FIG. 7 is a sectional view of an image forming apparatus according to a fourth embodiment of the present invention.

In the embodiments described in conjunction with FIGS. 1, 4, 5 and 6, the transfer rotatable member is disposed at a lower position in the apparatus. However, this is not limiting and, as shown in FIG. 7, the cartridge 20 and the black developing device 10BK and the optical device may be disposed below the rotatable member 16 in the main assembly. In FIG. 7, the individual means have the same structures as in FIG. 1, and therefore, the detailed descriptions are omitted by assigning the same reference numerals to the corresponding elements.

In the foregoing embodiments, the cartridge includes a charger which may be in the form of a contactable charging member as disclosed in U.S. Pat. No. 4,851,960. It may be left in the main assembly.

In the foregoing embodiments, the cartridge contains the cleaning device as a unit. However, from the standpoint of preventing contamination of the inside of the main assembly due to the scattering of the developer, it is preferable that the developing device, the cleaning device and the image bearing member are mounted or dismounted as a unit. However, this is not limiting, and the cleaning device may be separate from the cartridge containing the plural developing units and is mounted to the main assembly.

In the foregoing embodiments, the color images are formed through a process wherein the process of latent image formation, development thereof and the image transfer is repeated plural times so that images are superposedly transferred onto the recording material to provide a color image. However, this is not limiting and the color image forming process is usable in which the process including the latent image formation on the image bearing member, the development thereof and the image transfer onto an intermediate transfer material, and the process is repeated plural times, and the images superposed on the intermediate transfer material is transferred at once onto the recording material. Alternatively, the latent image formation is repeated a plurality of times on the image bearing member so that superposed images are formed on the image bearing member, and the superposed images are transferred at once onto a recording medium to provide the color image.

The transfer rotatable member may be in the form of a transfer drum disclosed in U.S. Ser. No. 333,044 which has been assigned to the assignee of this application.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus having a main assembly, said image forming apparatus comprising:

a process cartridge detachably mountable relative to said main assembly of said image forming apparatus, said process cartridge comprising an image bearing member and at least one developing means;

a developing unit, which is separable from said process cartridge, for supplying a developer to said image bearing member, said developing unit comprising a developing roller for bearing a developer, wherein when said apparatus is in operation, said developing roller is positioned in an operative position close to or in contact with said image bearing member;

mounting means for detachably mounting said process cartridge to said main assembly; and a cover openable relative to said main assembly having said mounting means, said cover being disposed to provide direct access to said process cartridge and to permit mounting and demounting of said process cartridge relative to said main assembly, wherein when said cover is opened, said developing roller moves away from the operative position.

2. An apparatus according to claim 1, wherein said at least one developing means contains one of yellow, magenta, and cyan developers.

3. An apparatus according to claim 1, wherein said main assembly is divisible into a first body and a second body, wherein said first body supports said process cartridge and said developing unit.

4. An apparatus according to claim 1, wherein said process cartridge further comprises charging means for uniformly charging said image bearing member and cleaning means for removing residual matter from said image bearing member.

5. An apparatus according to claim 1, wherein said process cartridge comprises at least three developing means respectively containing yellow, magenta, and cyan developers.

6. An apparatus according to claim 1, wherein said cover further provides direct access to said developing unit.

7. An apparatus according to claim 1, wherein said developing unit comprises a container for containing a black developer.

8. An image forming apparatus having a main assembly, said image forming apparatus comprising:

an image bearing member;

a developing unit detachably mountable relative to said main assembly, said developing unit comprising a developing roller for supplying a developer to said image bearing member, wherein when said apparatus is in operation, said developing roller is positioned in an operative position close to or in contact with said image bearing member;

mounting means for detachably mounting said developing unit to said main assembly; and a cover openable relative to said main assembly having said mounting means, said cover being disposed to provide direct access to said developing unit and to permit mounting and demounting of said developing unit relative to said main assembly, wherein when said cover is opened, said developing roller moves away from the operative position.

9. An apparatus according to claim 8, wherein said main assembly is divisible into a first body and a second body, wherein said first body supports said image bearing member and said developing unit.

10. An apparatus according to claim 8, wherein said developing unit comprises a container for containing a black developer.

11. An apparatus according to claim 8, wherein said main assembly further supports at least one additional developing means.

12. An apparatus according to claim 11, wherein said at least one additional developing means contains one of yellow, magenta, and cyan developers.

13. An apparatus according to claim 8, wherein said main assembly further comprises charging means for uniformly charging said image bearing member and cleaning means for removing residual matter from said image bearing member.

* * * * *

UNITED STATES PATENT AND TRADEMARK OFFICE

CERTIFICATE OF CORRECTION

PATENT NO. : 5,414,493

DATED : May 9, 1995

INVENTOR(S) : Fujii et al.

It is certified that error appears in the above-indentified patent and that said Letters Patent is hereby corrected as shown below:

On the title page item [56],

"5,124,747 6/1992 Hanada et al." should read --5,124,747 6/1992 Haneda et al.--.

COLUMN 1:

Line 16, "particularly" should read --more particularly--; and
Line 33, "to" should be deleted.

COLUMN 2:

Line 14, "are" should read --is--.

COLUMN 6:

Line 29, "are" should read --is--.

COLUMN 7:

Line 44, "a" should be deleted.

COLUMN 9:

Line 19, "is" should read --are--.

Signed and Sealed this

Nineteenth Day of September, 1995

*Attest:*

Bruce Lehman

BRUCE LEHMAN

*Attesting Officer*

*Commissioner of Patents and Trademarks*